US005980280A

United States Patent [19]

Zweigle

[11] Patent Number: 5,980,280

[45] Date of Patent: Nov. 9, 1999

[54] FASTENING DEVICE FOR MAINTAINING A PLUG CONNECTOR PART OF AN ELECTRIC PLUG CONNECTION IN AN OPEN POSITION

[75] Inventor: Peter Zweigle, Ditzingen, Germany

[73] Assignee: Robert Bosch GmbH, Stuttgart, Germany

[21] Appl. No.: 08/958,406

[22] Filed: Oct. 29, 1997

[30] Foreign Application Priority Data

Dec. 7, 1996 [DE] Germany ..... 296 21 317 U

[51] Int. Cl.[6] ..... H01R 13/62

[52] U.S. Cl. ..... 439/157; 439/188

[58] Field of Search ..... 439/152, 153, 439/157, 347, 188; 200/51.1, 51.09

[56] References Cited

U.S. PATENT DOCUMENTS 5,263,872 11/1993 Marpoe, Jr. et al. ..... 439/188
5,618,194 4/1997 Maue et al. ..... 439/157
5,803,756 9/1998 Furutani et al. ..... 439/188
5,857,859 1/1999 Machill et al. ..... 439/157

FOREIGN PATENT DOCUMENTS 36 45 179 9/1986 Germany .

*Primary Examiner*—Khiem Nguyen
*Assistant Examiner*—Michael C. Zarroli
*Attorney, Agent, or Firm*—Kenyon & Kenyon

[57] ABSTRACT

A fastening device for a plug connector part of an electric plug connection including receptacle chambers for assembly with contact elements and a slide that facilitates the application of joining and separating forces of the electric plug connection are provided in a contact carrier on the plug connector part. The fastening device, which may be a retention clamp, can be secured by a catch connection to a casing of the plug connector part. The fastening device brings switch elements of the plug connector part out of a position in which they overlap with respective receptacle chambers and secures the slide in an open position for subsequent coupling with a mating connector. When the plug connector part is delivered to an assembly plant, all the receptacle chambers can be assembled directly with contact elements and the plug connector part can be coupled with the mating connector by removing the fastening device.

6 Claims, 2 Drawing Sheets

FASTENING DEVICE FOR MAINTAINING A PLUG CONNECTOR PART OF AN ELECTRIC PLUG CONNECTION IN AN OPEN POSITION

BACKGROUND OF THE INVENTION

It is known from German Patent No. DE 36 45 179 C2 that a slide can be provided with a plug connector part which can be coupled with a mating connector to form a plug connection; this slide facilitates the application of the joining force and the separating force of the plug connection. The slide can be inserted into guide slots of the plug connector part.

In an open position in which the plug connector part and the mating connector can be paired with each other, the slide is inserted into the guide slot for a portion of its length and is held there by a releasable catch connection.

This catch connection can be overpressed, however, due to the shape of the catch elements, so that when the plug connector part is delivered by the manufacturer to an assembly site where the plug connector part is to be coupled to the mating connector, the slide can be displaced from its open position and the mating connector cannot be coupled.

This rechecking of the position of the slide at the assembly site and the corrections necessitated require additional efforts and operations in the assembly process and increase the cost of producing the electric plug connection.

In addition, the plug connector part may be provided with one or more springs that bridge contact elements of the plug connector part when the mating connector is not coupled. This short circuit may be used to light a pilot lamp or warning lamp to permit an optical indication of the fact that the plug connection has not been properly closed.

To bridge contact elements of the plug connector part, the switch springs must be preloaded and pressed onto the contact elements. However, if the plug connector part is delivered without contact elements by the manufacturer to an assembly plant where the plug connector part is provided with contact elements, the switch springs extend into the mounting space over the receptacle chambers for the contact elements due to the given preloading and the lack of retention by the contact elements which are not yet present and thus they interfere with assembly in a disadvantageous manner.

SUMMARY OF THE INVENTION

The fastening device according to the present invention for a plug connector part of an electric plug connection has the advantage that the above-mentioned inadequacies are avoided to a satisfactory extent. For this purpose, the fastening device is designed so that when assembled on the plug connector part, it secures the slide in the open position in a positive locking manner while also bringing the switch springs out of the position where they cover the respective receptacle chambers. In this way, it is always possible to reliably deliver the slide to the assembly site in the open position which is essential for later coupling of the plug connector part to the mating connector and to directly mount the contact elements in the receptacle chambers.

The prerequisites for inexpensive manufacturing of the plug connection are thus met.

DETAILED DESCRIPTION

Figure 1:
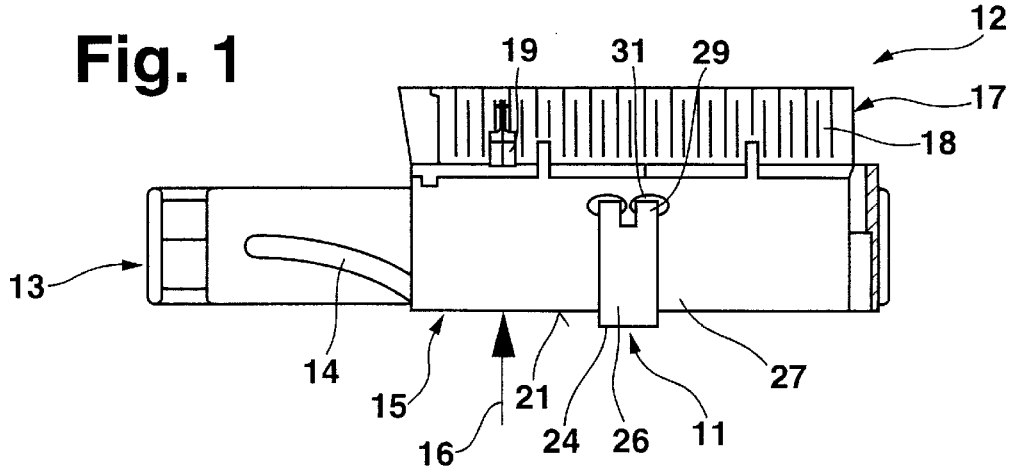
FIG. 1 shows the mounted fastening device, in a side view of the plug connector part.

FIG. 1 shows a fastening device 11 for a plug connector part 12, in which the plug connector part 12 can be coupled with a mating connector (not shown) to form an electric plug connection. To overcome the closing and separating forces of the plug connection, a slide 13 is provided having grooves serving as control devices 14 that work together with control elements of the mating connector in a known way so that a longitudinal displacement of slide 13 in a casing 15 of plug connector part 12 leads to a displacement of the respective mating connector in the plugging direction, corresponding to the direction of arrow 16.

In casing 15, plug connector part 12 has a contact carrier having multiple receptacle chambers 18 into which contact elements 19 can be inserted in the direction opposite the plugging direction. For illustration purposes, FIG. 1 shows a contact element 19, although unassembled receptacle chambers are assumed below.

Figure 2:
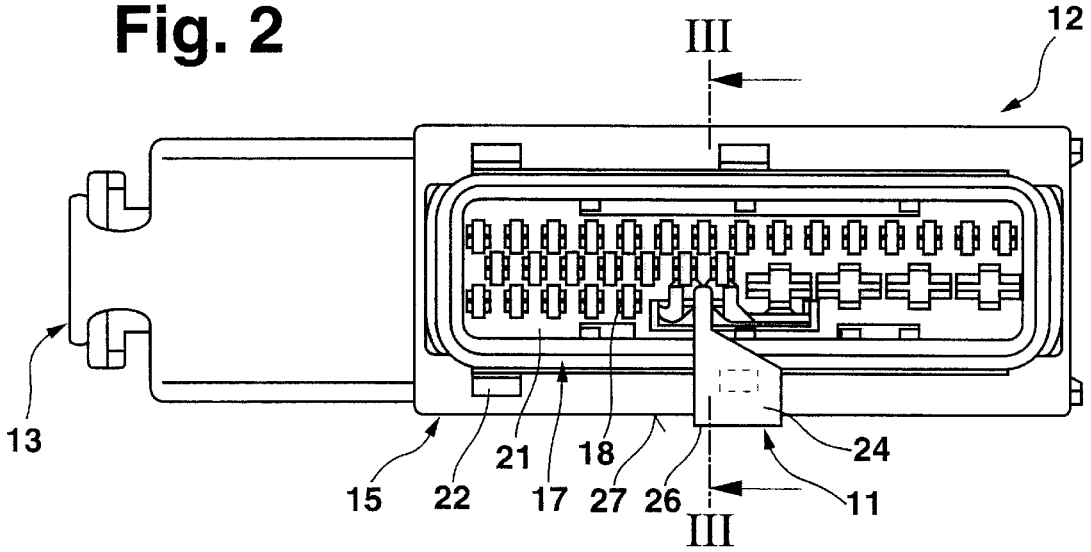
FIG. 2 shows a bottom view of the plug connector part.

FIG. 2 shows a bottom view of a mating side 21 of plug connector part 12 by means of which the latter is coupled to the mating connector. In an "open" position of slide 13, where plug connector part 12 can be combined with the mating connector, control elements of the mating connector, which are usually designed as short cylindrical pins, pass through recesses 22 in casing 14, the recesses being larger by a joining tolerance and provided on mating side 21, and engage in control devices 14 of slide 13. The control devices run across the plugging direction in alignment with recesses 22 in this position of slide 13.

Figure 3:
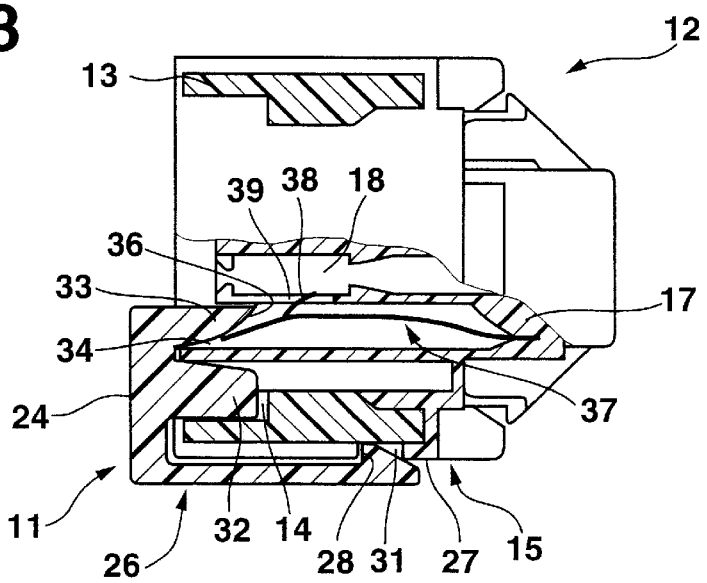
FIG. 3 shows a cross section along line III—III in FIG. 2.

Fastening device 11, which is schematically shown in FIGS. 1 and 2, is explained in greater detail with reference to FIG. 3. More specifically, the fastening device 11 is an angled plastic part in the manner of a retaining clamp which, when mounted on plug connector part 12, is in contact at a bottom 24 thereof and a wall 26 thereof is in contact with a side face 27 of casing 15 of plug connector part 12, the side face being perpendicular to mating side 21.

Fastening device 11 is detachably attached to plug connector by a releasable catch connection formed by catch shoulders 28 which project away from arms 29 mounted on an end of the wall 26. The catch shoulders 28 engage catch orifices 31 formed in the side face 27 (FIG. 1).

When fastening device 11 is mounted on plug connector part 12, a first projection 32 of fastening device 11 with a trapezoidal cross-sectional area that projects from bottom 24 enters one of the grooves of a respective control device 14 via the corresponding recess 22 so that contact between the first projection 32 and the groove of the control device 14 forms a positive locking connection between casing 15 and slide 13. Thus, the slide 13 can be displaced out of the open position only by removing the fastening device 11.

In addition, when fastening device 11 is mounted on plug connector part 12, a wedge-shaped second projection 33 which also projects from bottom 24 engages a retaining orifice 34 of contact carrier 17 from mating side 21, with a run-up oblique surface 36 provided on second projection 33 being engaged at the free ends by at least two curved, resilient, electrically conducting switch elements 37 which are fixed at one end in contact carrier 17 and have been displaced by the run-up oblique surface so that a contact tongue 38 provided on each switch element 37 is pivoted out of through-hole 39 of a respective receptacle chamber 18. Thus, with fastening device 11 mounted, there is also free access for mounting contact elements 19 in these receptacle chambers 18, as is already the case in the other receptacle chambers 18 that are not acted upon by switch elements 37. Those skilled in the art will recognize that the first and second projections 32, 33 may be combined as a single common projection.

A plug connector part 12 that is provided with a fastening device 11 can be supplied by a manufacturer, in particular for plastic parts, to an assembly plant where contact elements 19 can be mounted directly in this way and plug connector part 12 can be coupled with the mating connector without additional operations when fastening device 11 is removed due to the fact that slide 13 is secured in the open position when delivered. Such a plug connector part 12 equipped with a removable fastening device 11 permits inexpensive manufacture of an electric plug connection.

Figure 4:
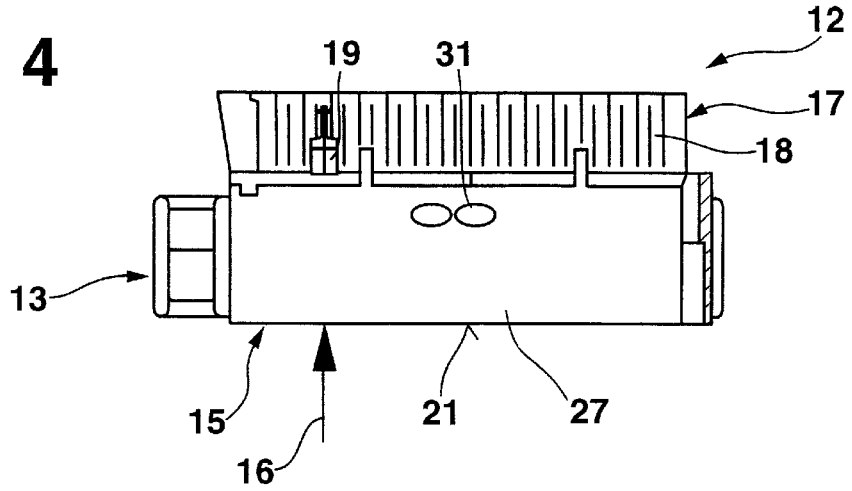
FIG. 4 shows the plug connector part of FIG. 1 in a closed position with the fastening device removed therefrom.
Figure 5:
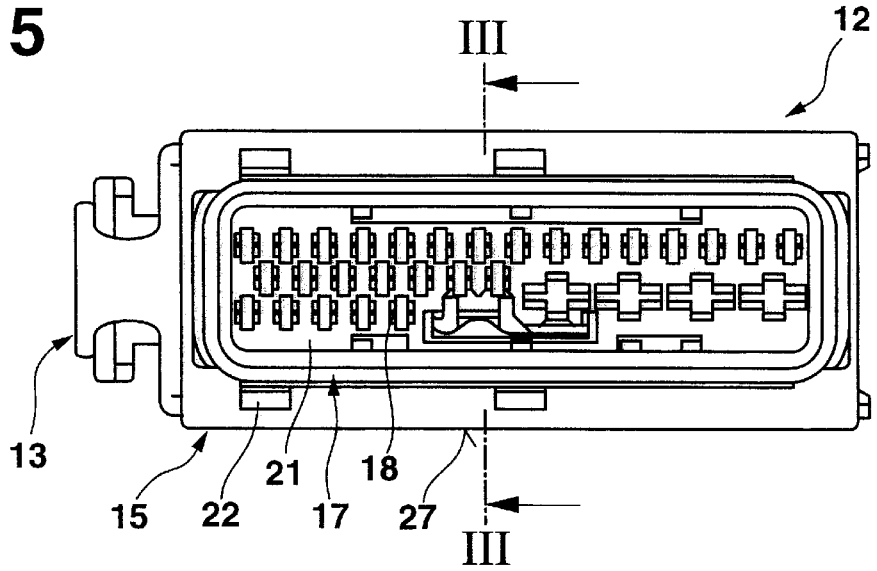
FIG. 5 shows a bottom view of the plug connector of FIG. 1 in the closed position with the fastening device removed therefrom.
Figure 6:
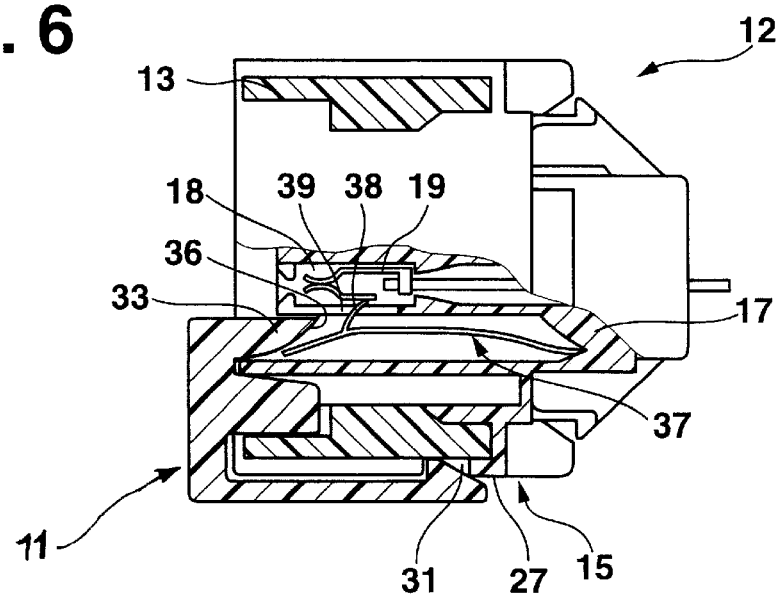
FIG. 6 shows a cross section along line VI—VI of FIG. 5.

FIGS. 4 through 6 show the plug connector part 12 in a closed position with the fastening device 11 removed therefrom.

What is claimed is:

1. A fastening device for a plug connector of an electric plug connection, the plug connector including a casing having recesses, a contact carrier having receptacle chambers in the casing, contact elements for insertion into the receptacle chambers in a direction opposite a plugging direction for support, and at least one switch element, the fastening device comprising:

a slide for insertion into the plug connector in a direction lateral with respect to the plugging direction, the slide including control devices extending laterally with respect to the plugging direction, the control devices being aligned, when the casing is in an open position, with the recesses in the casing;

a first projection for engaging, when the slide is in the open position, at least one of the control devices of the slide through at least one of the recesses in the casing to secure the slide in the open position; and a second projection for displacing the at least one switch element out of a position in which the at least one switch element extends into a corresponding one of the receptacle chambers.

2. The fastening device according to claim 1, wherein when the slide is in the open position, the plus connector part is configured to be coupled to a mating connector.

3. The fastening device according to claim 1, wherein the fastening device is detachably attached to the casing.

4. The fastening device according to claim 1, wherein the fastening device is formed as a retaining clamp which is pushed onto the casing in the plugging direction and is held on the casing by a releasable catch connection.

5. The fastening device according to claim 1, wherein, when the fastening device is pushed onto the casing, the second projection extends into a retaining orifice formed in the contact carrier to engage the contact carrier and wherein the second projection has a run-up surface extending in a direction oblique to the plugging direction for displacing a free end of the at least one switch element in a direction lateral to the plugging direction.

6. The fastening device according to claim 1, wherein the fastening device is composed of a plastic material, and the first and second projections are combined in a common projection.

* * * * *